US011598611B2

(12) United States Patent
LeMarbe

(10) Patent No.: US 11,598,611 B2
(45) Date of Patent: Mar. 7, 2023

(54) COMBINATION DELTOID AND BICEP GUARD

(71) Applicant: Point Blank Enterprises, Inc., Pompano Beach, FL (US)

(72) Inventor: Randall J. LeMarbe, Pompano Beach, FL (US)

(73) Assignee: POINT BLANK ENTERPRISES, INC., Pompano Beach, FL (US)

( * ) Notice: Subject to any disclaimer, the term of this patent is extended or adjusted under 35 U.S.C. 154(b) by 0 days.

(21) Appl. No.: 17/412,770

(22) Filed: Aug. 26, 2021

(65) Prior Publication Data

US 2022/0357132 A1 Nov. 10, 2022

Related U.S. Application Data

(60) Provisional application No. 63/184,603, filed on May 5, 2021.

(51) Int. Cl.
*A41D 13/05* (2006.01)
*F41H 1/02* (2006.01)
*A41D 13/00* (2006.01)

(52) U.S. Cl.
CPC ..... *F41H 1/02* (2013.01); *A41D 13/0005* (2013.01)

(58) Field of Classification Search
CPC ..... F41H 1/02; A41D 13/0512
USPC ..... 2/2.5
See application file for complete search history.

(56) References Cited

U.S. PATENT DOCUMENTS 3,295,235 A * 1/1967 Tauber ..... G09F 3/185 224/230
4,993,076 A * 2/1991 Dierickx ..... A63B 71/12 2/466
6,339,866 B1 * 1/2002 French ..... A41D 27/08 40/594
6,519,782 B2 * 2/2003 Collins ..... A63B 71/12 2/463
6,845,522 B2 * 1/2005 Beland ..... A63B 71/12 2/16
7,076,806 B1 * 7/2006 Van Winkle ..... F41H 1/02 2/2.5
7,103,924 B2 * 9/2006 Morrow ..... A63B 71/12 2/461
7,506,384 B2 * 3/2009 Ide ..... A63B 71/12 2/459
7,647,651 B2 * 1/2010 Contant ..... A41D 13/0518 2/459
7,937,780 B2 * 5/2011 Matic ..... F41H 1/02 2/465

(Continued)

*Primary Examiner* — Tajash D Patel
(74) *Attorney, Agent, or Firm* — Geoffrey Lottenberg; Berger Singerman LLP

(57) ABSTRACT

A deltoid guard has a body-conforming surface and can be removably attached to a body armor component by an expandable, releasable connector to facilitate articulation and expansion and contraction relative to the body armor component. An expandable strap is located on one side of the deltoid guard to retain the guard against the wear's body. A bicep guard can be attached to the deltoid guard such that the bicep guard can articulate with respect to the deltoid guard. The deltoid guard includes an opening to receive ballistic material. An identification panel can be removably attached to the surface of the deltoid guard.

18 Claims, 7 Drawing Sheets

(56) References Cited

U.S. PATENT DOCUMENTS

| | | | | |
|---|---|---|---|---|
| 8,214,929 | B2 * | 7/2012 | Kraemer | A63B 71/12 2/459 |
| 8,578,513 | B2 * | 11/2013 | Carlson | F41H 1/02 2/2.5 |
| 10,871,351 | B2 * | 12/2020 | Becker | F41H 1/02 |
| 2011/0004968 | A1 * | 1/2011 | Morgan | B63C 9/135 2/2.5 |

* cited by examiner

COMBINATION DELTOID AND BICEP GUARD

CROSS REFERENCE TO RELATED APPLICATIONS

This application claims the benefit of U.S. Provisional Application No. 63/184,603 filed on May 5, 2021.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the invention of the present invention. It will be apparent, however, to one skilled in the art that the invention may be practiced without some of these specific details. Throughout this description, the embodiments and examples shown should be considered as exemplars, rather than as limitations on the invention. That is, the following description provides examples, and the accompanying drawings show various examples for the purposes of illustration. However, these examples should not be construed in a limiting sense as they are merely intended to provide examples of the invention rather than to provide an exhaustive list of all possible implementations of the invention.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment.

Furthermore, the particular features, structures or characteristics may be combined in any suitable manner in one or more embodiments.

Figure 1:
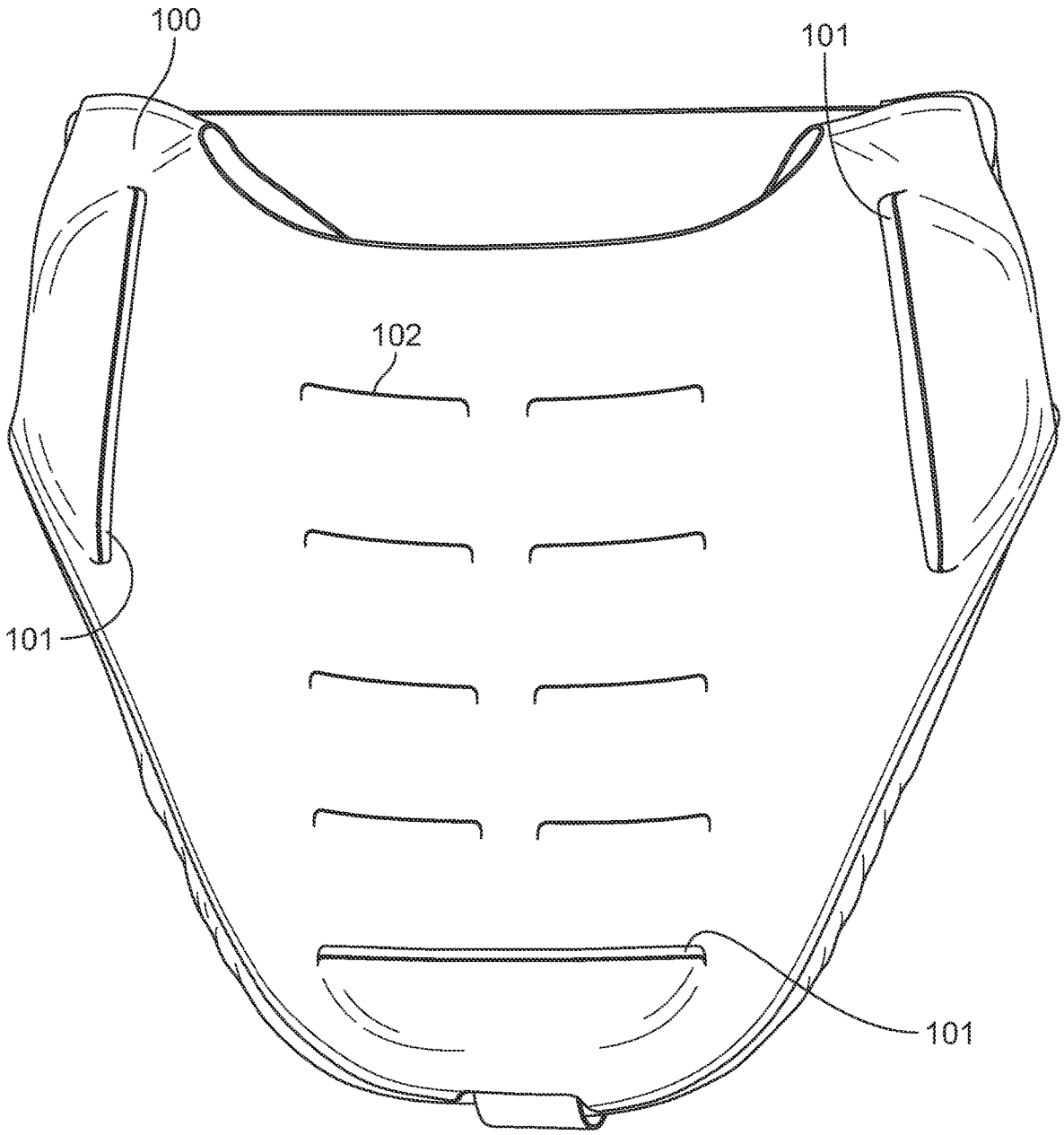
FIG. 1 is a front view of the deltoid guard.
Figure 2:
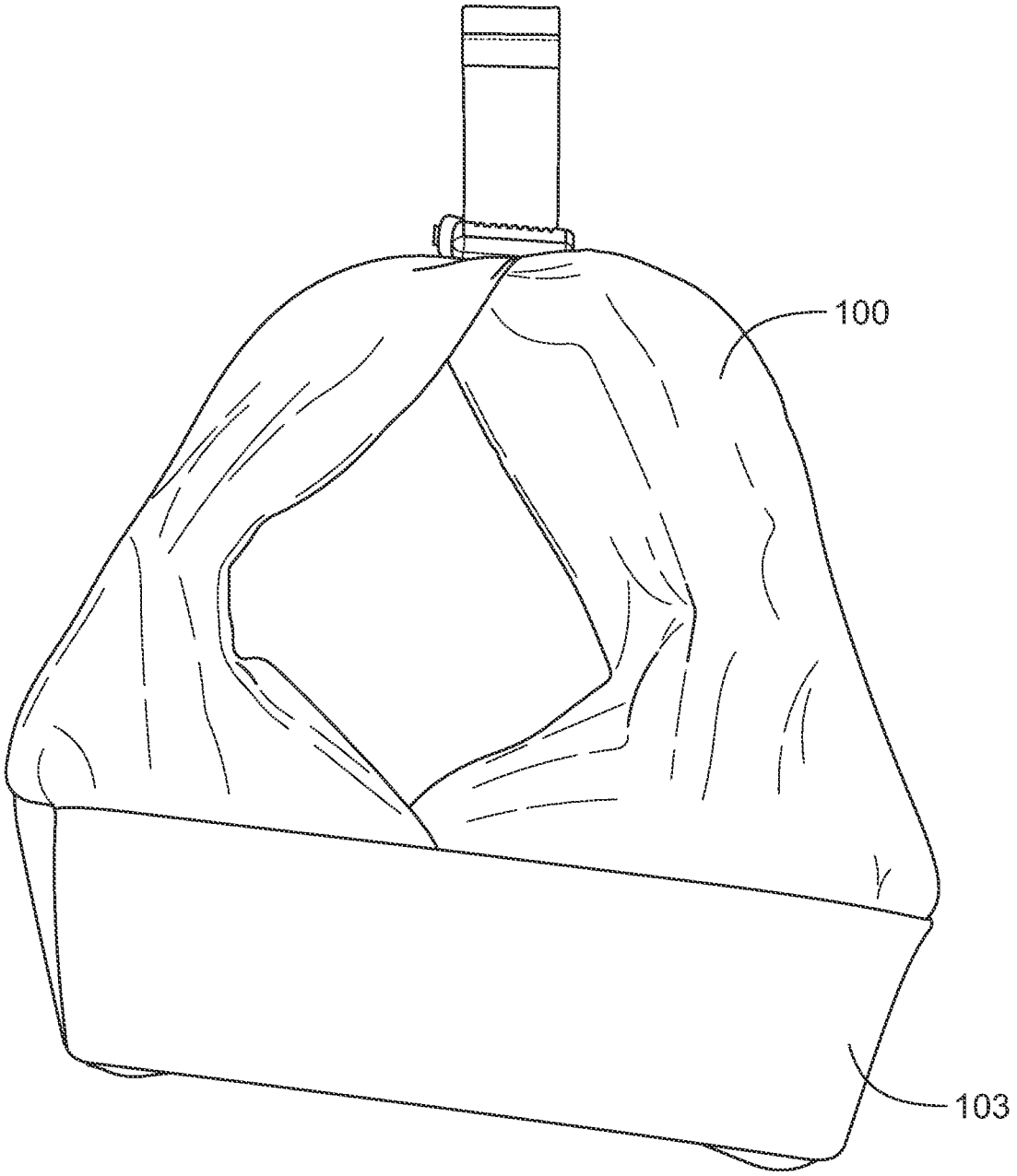
FIG. 2 is a rear view of the deltoid guard.
Figure 3:
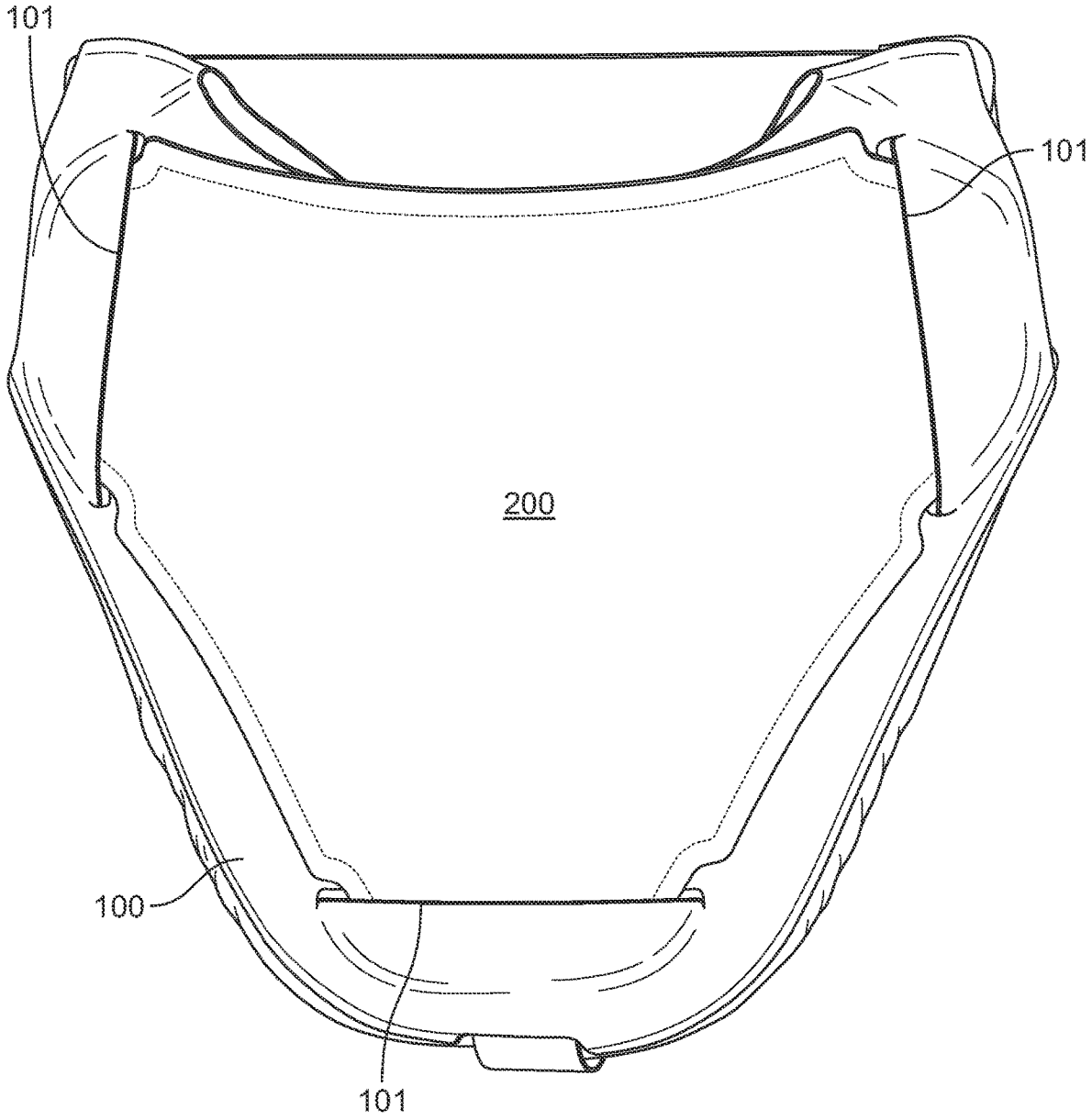
FIG. 3 is a front view of the deltoid guard showing an identification panel.

FIG. 1 is a front view of the deltoid guard 100, which has a generally triangular or trapezoidal shape with a body-conforming surface and, in some embodiments, has one or more openings 101 which receive an identification panel 200 (shown in FIG. 3). In some embodiments, the surface of the deltoid guard including MOLLE-compatible openings 102 to receive and retain accessories. As shown in FIG. 2, the interior of the deltoid guard 100 accessible and is configured to receive and retain soft armor, hard armor, fragmentation armor, or combinations thereof. Also at the rear of the deltoid guard 110 is an expandable element 103 such as an elastic strap which retains the guard against the arm of the wearer. FIG. 3 depicts an example of the attachment of a wedge-like identification panel 200 onto the deltoid guard, namely by inserting one or more corners or edges, or perimetrical insertion tangs, of the identification panel 200 into the one or more corresponding openings 101 on the deltoid guard. The identification panel 200 may be reversible and printable and may also include hook and loop fastener for additional adhesion to the deltoid guard 100. In some embodiments, however, hook and loop fastener is obviated due to the insertion of the corners or edges of the identification panel 200 into one or more corresponding openings 101 on the deltoid guard 100.

Figure 4A:
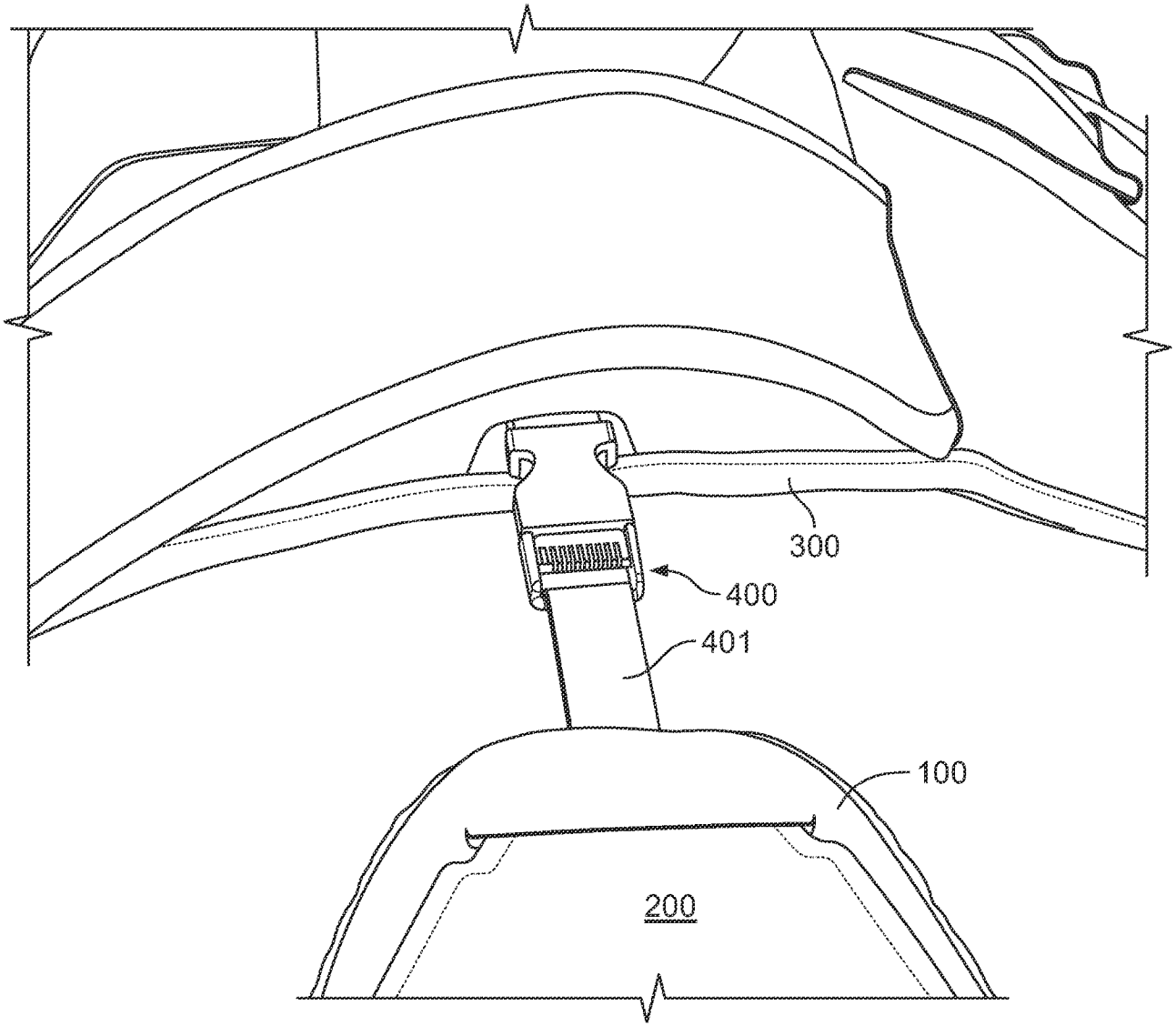
FIG. 4A is a perspective view of the deltoid guard attached to body armor showing a first position of articulation.
Figure 4B:
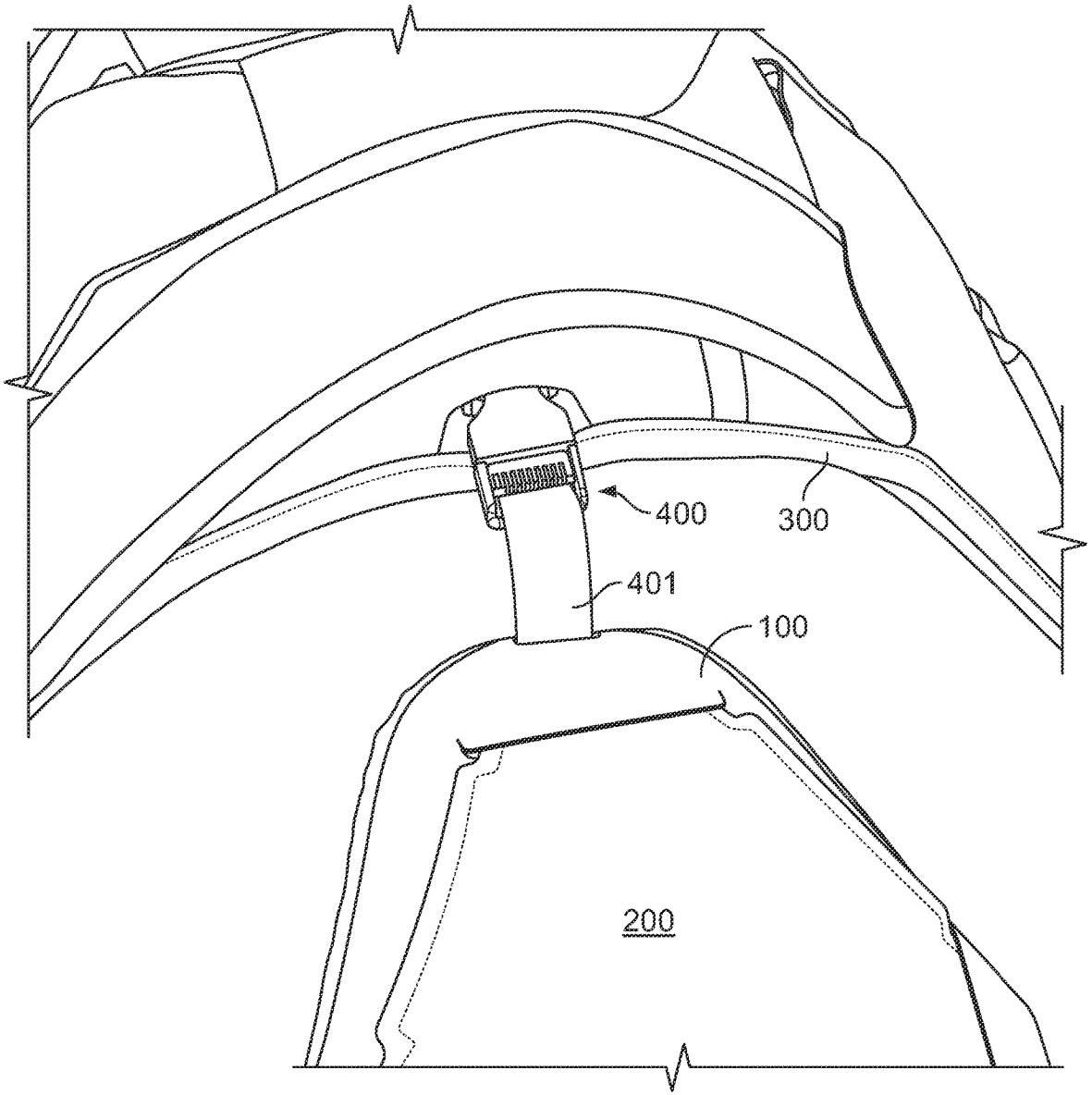
FIG. 4B is a perspective view of the deltoid guard attached to body armor showing a second position of articulation.
Figure 5:
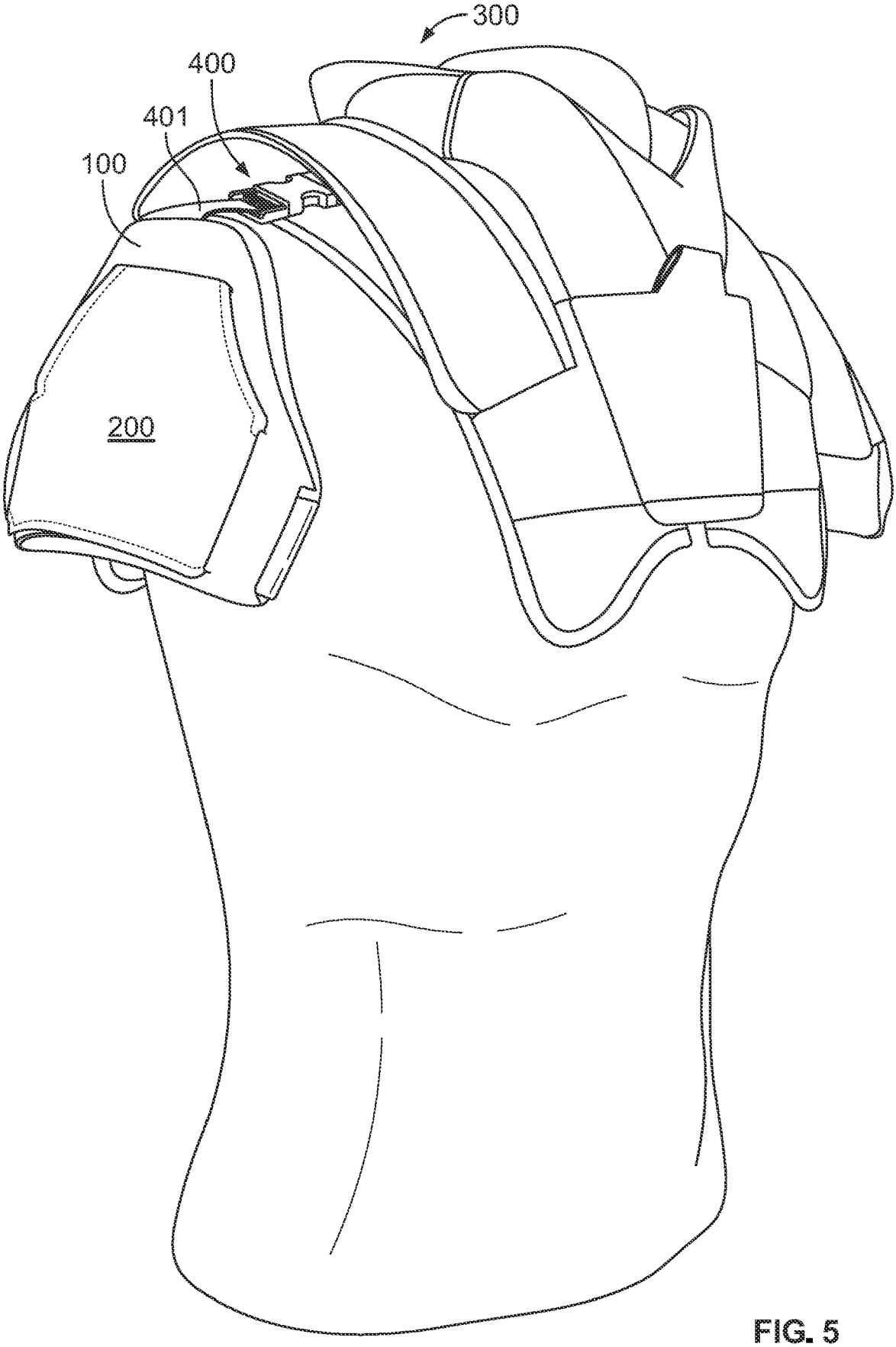
FIG. 5 is a perspective view showing the deltoid guard attached to body armor.

FIGS. 4A-4B depict the attachment of the deltoid guard 100 to an exemplary body armor component 300. In some embodiments, a small releasable fastener connection 400 such as a buckle is attached between the deltoid guard 100 and the body armor component 300. Other releasable connections such as snaps, hook and loop, and the like can be employed. In other embodiments, the deltoid guard 100 may be fixed to the body armor component 300, i.e. attached in a non releasable manner. In either configuration, in some embodiments an expandable material 401 may be provided at the connection 40 to facilitate expansion and articulation of the deltoid guard 100 with respect to the body armor component 300 to aid wearer comfort. Expansion and articulation between two positions is shown in FIGS. 4A-4B. FIG. 5 shows a perspective view of the deltoid guard 100 attached to a body armor component 300 configured as an upper body protector. As shown, the deltoid guard 100 extends laterally from the body armor component 300 and hangs over the deltoid area of the wearer and does not cover or protect the chest area of the wearer.

Figure 6:
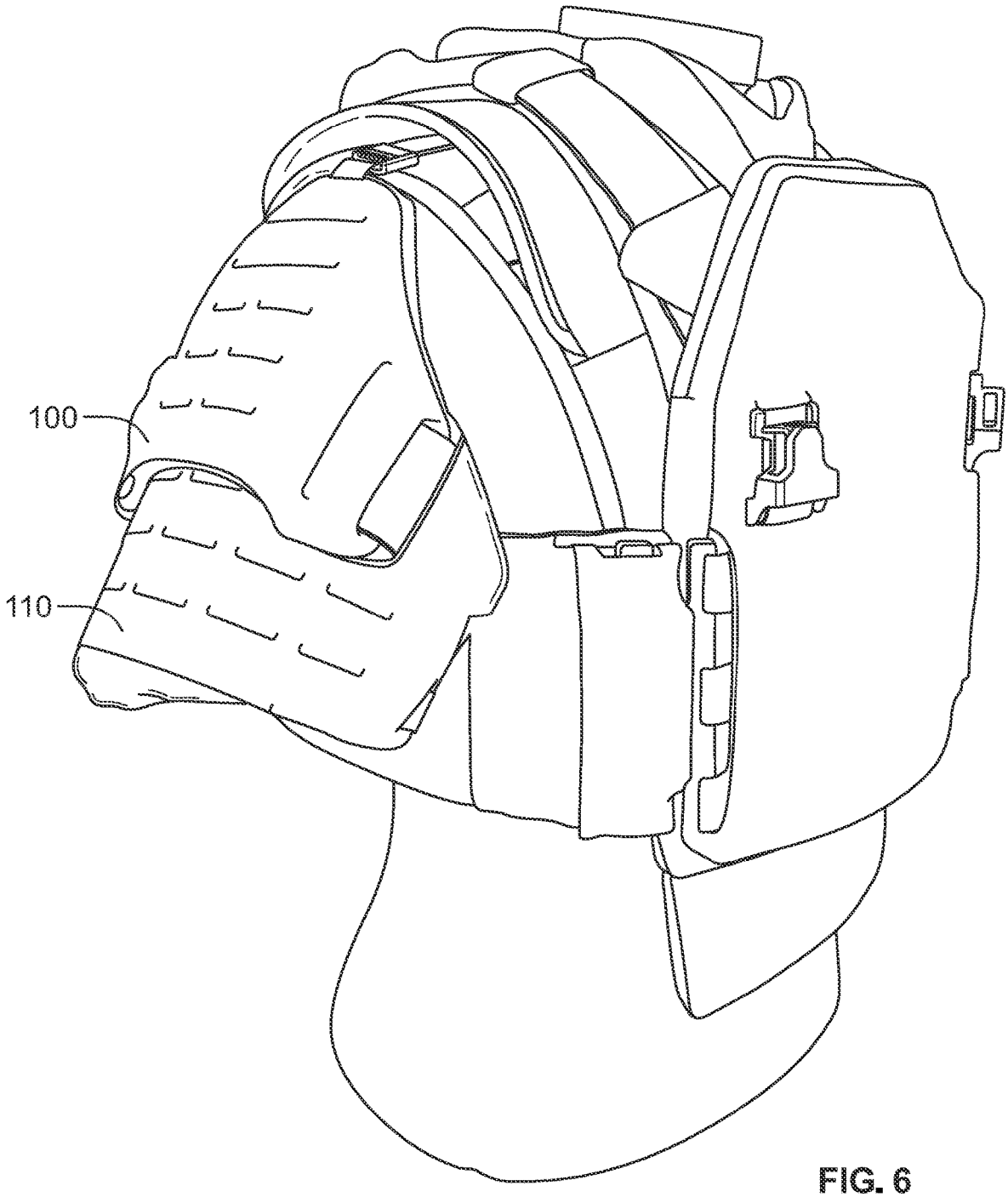
FIG. 6 is a perspective view of the deltoid guard attached to body armor and also showing a bicep protector.

In some embodiments, as shown in FIGS. 5 and 6, the deltoid guard 100 is relatively smaller than traditional designs and does not protect the bicep area or chest area in order to enhance mobility. However, as shown in FIG. 6, a supplemental bicep guard 110 may be implemented, which attaches to the deltoid guard such that the bicep guard can articulate with respect to the deltoid guard. In some embodiments, the bicep guard 110 is disposed at least partially underneath the deltoid guard 100 and attaches, removably or otherwise, either to the deltoid guard or the body armor component 300 by a buckle, elastic, and/or wedge received in an opening on the deltoid guard 100 body armor component 300. As shown in FIG. 6, the deltoid guard 100 extends laterally from the body armor component 300 and the deltoid guard 100 and bicep guard 110 combination hangs over the deltoid and bicep areas of the wearer and do not cover or protect the chest area of the wearer. This allows for a modular, scalable arm protection system that maximizes comfort and mobility.

As noted above, FIG. 2 shows the opened state of the interior aspect of the deltoid guard 100 in which armor (soft, hard, fragmentation, or the like) is inserted and retained. In some embodiments, the deltoid guard 100 includes an opening 104 that is zippered or that has hook and loop fastener to provide a much easier means for adding and removing body armor to the deltoid guard.

It is appreciated and understood that the deltoid guard described herein can be of a multi-material construction. In some embodiments, the fabrics that face inward toward the wearer or otherwise come in contact with the body of the wearer, such as the collar, are composed of a no-snag pack cloth or nylon material. This avoids snagging on rough skin or facial hair.

It is to be noticed that the term "opening" as used herein and in the claims shall be deemed limited as it may refer to any number of slots, slits, apertures, channels, covered areas, or the like. It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise.

Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The enumerated listing of items does not imply that any or all of the items are mutually exclusive, unless expressly specified otherwise. The terms "a", "an" and "the" mean "one or more", unless expressly specified otherwise.

Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A deltoid guard, comprising a body-conforming surface and configured to be removably attached to a body armor component, wherein the deltoid guard extends laterally from the body armor component and hangs over a deltoid area of a wearer and does not cover or protect a chest area of the wearer; and a bicep guard removably attached to the deltoid guard such that the bicep guard can articulate with respect to the deltoid guard.

2. The deltoid guard of claim 1, wherein the deltoid guard is removably attached to the body armor component by a releasable connector.

3. The deltoid guard of claim 2, wherein the releasable connector includes an expandable material to facilitate articulation and expansion and contraction relative to the body armor component.

4. The deltoid guard of claim 1, wherein one side of the deltoid guard includes expandable strap configured to retain the deltoid guard against a wearer.

5. The deltoid guard of claim 1, wherein the body armor component removably receives an identification panel.

6. The deltoid guard of claim 5, wherein the identification panel is attached to the body armor component without hook and loop fastener.

7. The deltoid guard of claim 5, wherein the identification panel includes one or more edges which are removably received in one or more corresponding openings on the deltoid guard.

8. The deltoid guard of claim 1, wherein the surface of the deltoid guard includes at least MOLLE-compatible opening.

9. The deltoid guard of claim 1, including an opening configured to receive ballistic material.

10. A deltoid guard, comprising:

a body-conforming surface and configured to be removably attached to a body armor component, wherein the deltoid guard is removably attached to the body armor component by a releasable connector, wherein the releasable connector includes an expandable material to facilitate articulation and expansion and contraction relative to the body armor component;

an expandable strap located on one side of the deltoid guard;

a bicep guard removably attached to the deltoid guard such that the bicep guard can articulate with respect to the deltoid guard; and wherein the deltoid guard extends laterally from the body armor component and the deltoid guard and bicep guard hang over deltoid and bicep areas of a wearer and do not cover or protect a chest area of the wearer.

11. On a body armor component, a deltoid guard comprising a body-conforming surface and configured to be removably attached to the body armor component wherein the deltoid guard extends laterally from the body armor component and hangs over a deltoid area of a wearer and does not cover or protect a chest area of the wearer; and a bicep guard removably attached to the deltoid guard such that the bicep guard can articulate with respect to the deltoid guard.

12. The body armor component of claim 11, wherein the deltoid guard is removably attached to the body armor component by a releasable connector.

13. The body armor component of claim 12, wherein the releasable connector includes an expandable material to facilitate articulation and expansion and contraction relative to the body armor component.

14. The body armor component of claim 11, wherein one side of the deltoid guard includes expandable strap configured to retain the deltoid guard against a wearer.

15. The body armor component of claim 11, wherein the body armor component removably receives an identification panel.

16. The body armor component of claim 15, wherein the identification panel is attached to the body armor component without hook and loop fastener.

17. The body armor component of claim 15, wherein the identification panel includes one or more edges which are removably received in one or more corresponding openings on the deltoid guard.

18. The body armor component of claim 11, wherein the surface of the deltoid guard includes at least MOLLE-compatible opening.

* * * * *